US006148735A

United States Patent [19]

Sauter et al.

[11] Patent Number: 6,148,735

[45] Date of Patent: Nov. 21, 2000

[54] LIGHT WEIGHT GONDOLA CAR

[75] Inventors: Kerry L. Sauter, Sidman; Todd L. Lydic, Johnstown; Amy Miller, Windber; David A. Lohr, Somerset; Robert Dorian, Johnstown, all of Pa.

[73] Assignee: Johnstown America Corporation, Johnstown, Pa.

[21] Appl. No.: 08/882,372

[22] Filed: Jun. 25, 1997

[51] Int. Cl.[7] ..... B61D 17/08

[52] U.S. Cl. ..... 105/406.1; 105/199.3; 105/409; 105/420

[58] Field of Search ..... 105/199.1, 199.3, 105/406.1, 409, 410, 411, 420, 416; 296/187, 191

[56] References Cited

U.S. PATENT DOCUMENTS

| | | | |
|---|---|---|---|
| 2,010,381 | 8/1935 | Small | 105/406.1 |
| 2,054,784 | 9/1936 | Gilpin | 105/406.1 |
| 2,150,897 | 3/1939 | Nystrom | 105/409 |
| 3,954,066 | 5/1976 | Heap | 105/420 |
| 4,128,062 | 12/1978 | Roberts | 105/420 |
| 4,168,665 | 9/1979 | Needham et al. | 105/406.1 |
| 4,254,714 | 3/1981 | Heap | 105/406.1 |
| 4,690,072 | 9/1987 | Willie et al. | 105/199.3 |
| 4,771,705 | 9/1988 | Przybylinski et al. | 105/406.1 |
| 5,438,934 | 8/1995 | Goding | 105/199.3 |
| 5,613,726 | 3/1997 | Hobbs et al. | 105/409 |
| 5,746,136 | 5/1998 | Hawthorne et al. | 105/199.3 |
| 5,813,353 | 9/1998 | Sauter | 105/406.1 |

*Primary Examiner*—S. Joseph Morano
*Attorney, Agent, or Firm*—Webb Ziesenheim Logsdon Orkin & Hanson, P.C.

[57] ABSTRACT

A light weight gondola car having side walls constructed of a plurality of upper and lower sheets with a longitudinal stiffener being formed from lower portions of the upper and lower sheets. A bolster transition stake joins the side sheet, top chord, bolster web, and side sill for increased strength. The load from the truck assemblies is transmitted to the car body through load carriers. Diagonal truss members strengthened the end panels. The body frame is connected to the center sill with a reinforcement plate. The center sill and draft sills are interconnected by a tie plate.

41 Claims, 10 Drawing Sheets

LIGHT WEIGHT GONDOLA CAR

BACKGROUND OF THE INVENTION

1. Field of the Invention

This invention relates in general to railroad cars and, in particular, to a light weight gondola car.

2. Summary of the Prior Art

Rail cars of numerous designs have been developed to carry bulk material. One type of conventional rail car is known as a gondola car which is particularly useful in carrying heavy bulk material, such as coal, sand, and gravel among other lading. A gondola car typically is loaded from an open top and possesses a continuous center sill. An example of a well known gondola rail car is described in U.S. Pat, No. 4,361,097 for RAILWAY GONDOLA CARS issued to Jones et al. on Nov. 30, 1982. By applicable standards established by the Association of American Railroads (A.A.R.), the maximum weight of any type of rail car, including a gondola car, must comply with prescribed limits. In addition, the rail car must also possess dimensions to meet A.A.R. clearance plates. The maximum loading to be carried by a rail car is therefore limited by the empty structural weight of the rail car in absence of its lading. By reducing the structural weight of a rail car, it is possible to increase its volumetric capacity and still meet applicable standards for loading capacity. None of the prior gondola cars have effectively reduced the empty weight of the car with a design which is economical and efficient in operation. Several structural components significantly contribute to weight, including the center sill, truck assemblies, bolster design, and the overall design and material of the body, including the side walls and other parts. Attempts have been made in the past to redesign one or more of the foregoing components to reduce weight without optimally providing an efficient, lightweight design for a gondola car.

SUMMARY OF THE INVENTION

It is therefore an objective of the invention to provide a lightweight gondola car having an enhanced load capacity. The gondola car of the invention possesses an improved body design by which external posts are eliminated allowing for greater width between the sidewalls for increased volumetric capacity. The sidewalls are free from protruding side posts and provide greater aerodynamic efficiency and reduced operating costs.

The gondola car herein disclosed includes unique load carriers on the truck assemblies through which loading is transferred to the body in an improved manner. The load carriers allow the use of truck assemblies having a lighter design than previously used for gondola cars. The load carriers are in the form of tubular means having an outer box which can be adjusted relative to the tube. The sidewalls of the gondola car of the application comprise a plurality of panels interconnected by vertical side stakes having vertical wear pads projecting externally. The wear pads serve to protect the side walls from contact with the rotary dumper housing during a rotary dumping operation. The sidewalls are strengthened by a horizontal stiffener means formed from the side sheets and tied together by ties along a horizontal seam. The end side panels of the invention are uniquely reinforced by diagonal truss members affixed to the side sheet between the upper chords and adjacent side stakes.

Loads to the body of the gondola car herein disclosed are transferred through an improved transition stake. The transition stake joins the side sheet and end side sheet and is connected to the bolster web, the side sill and the top chord for improved strength characteristics. In addition, the center sill is constructed with an improved lightweight design and is tied to the draft sill by a tie plate means. The body of the gondola car herein includes K-frame reinforcement members which are attached to a reinforcement plate within the center sill.

DESCRIPTION OF THE PREFERRED EMBODIMENTS

Figure 2:
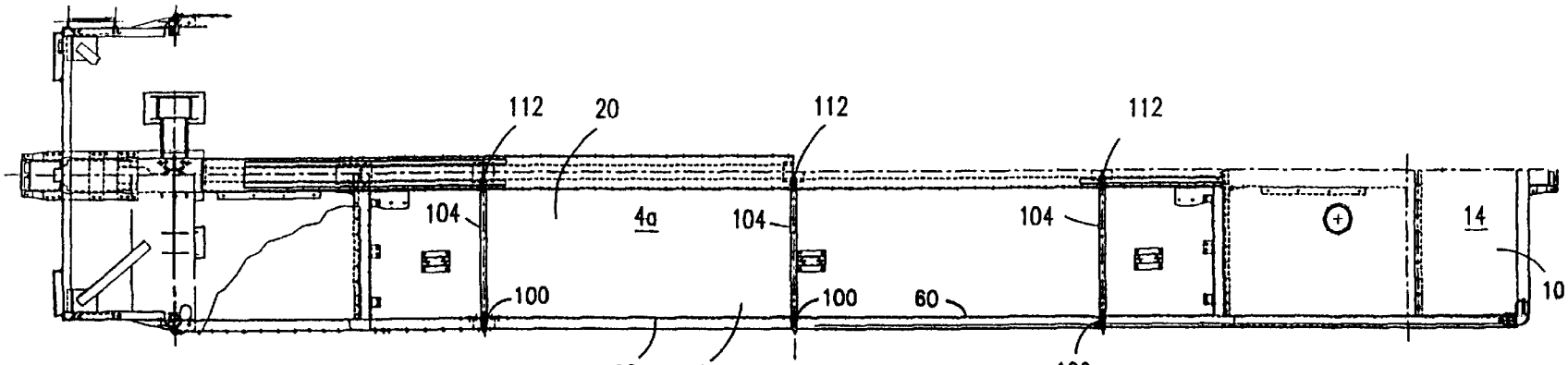
FIG. 2 is a partial top plan view of the gondola car of FIG. 1.
Figure 3:
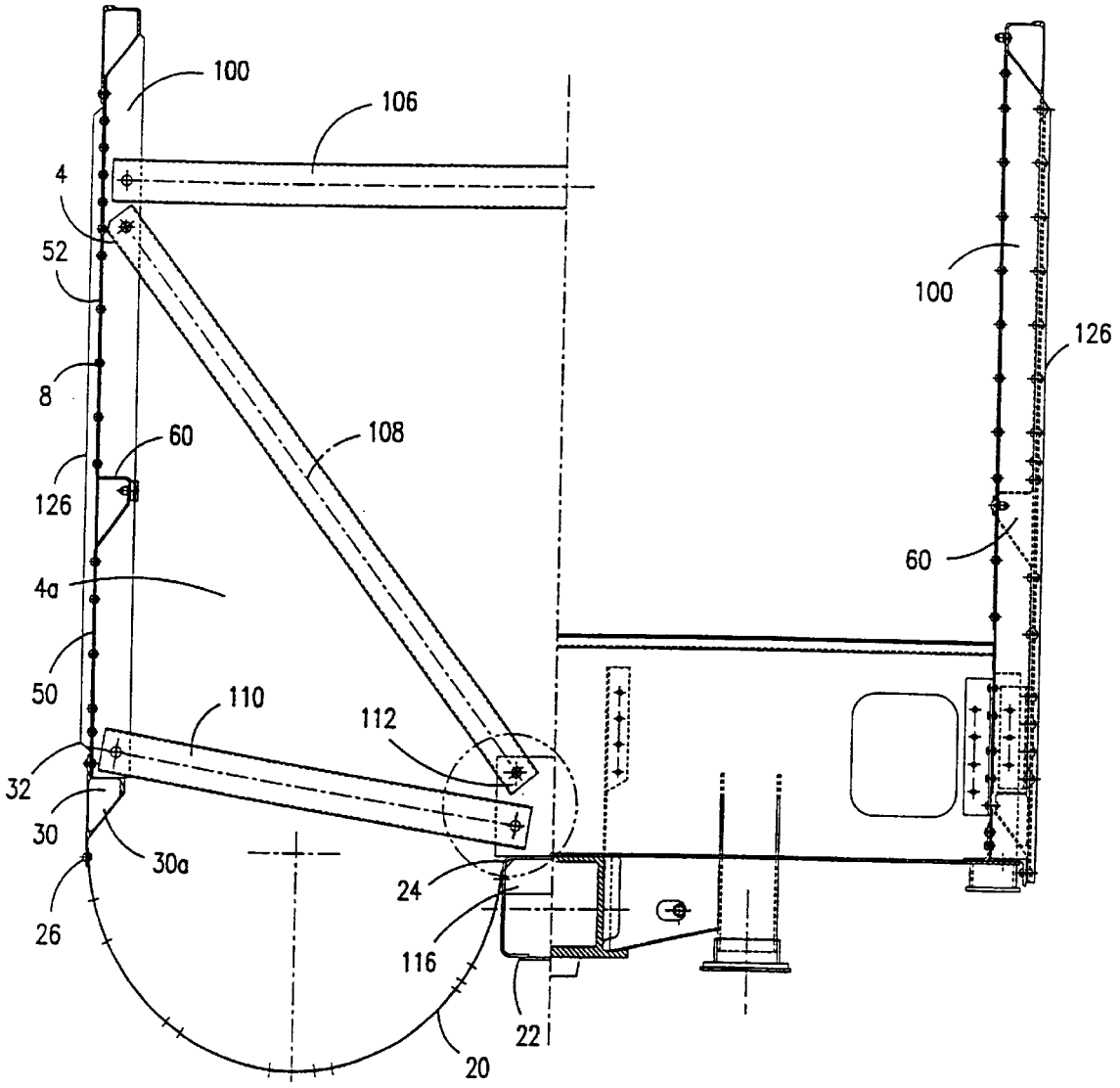
FIG. 3 is a partial end elevational view, with parts removed and in section of FIG. 1.
Figure 7:
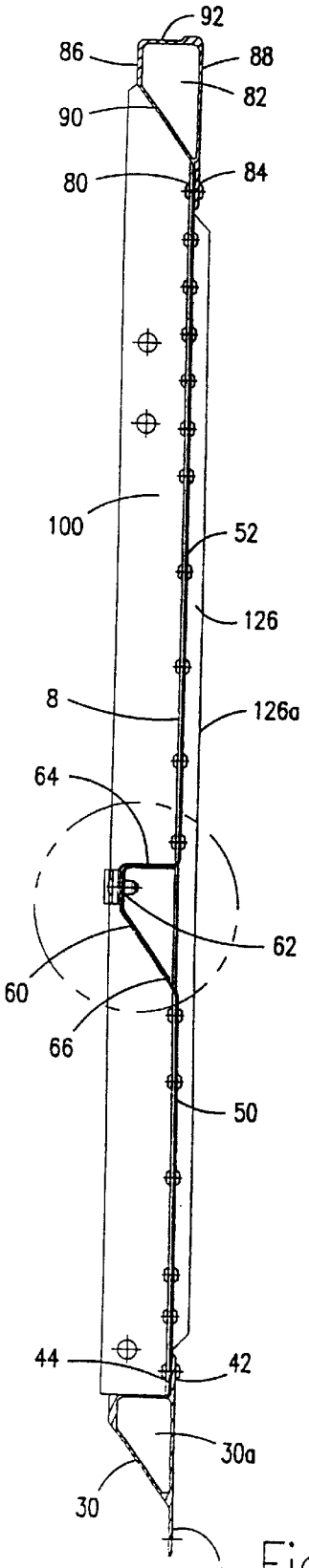
FIG. 7 is an end elevational view of the side sheets and reinforcement beam of the invention taken along line 7—7 of FIG. 1.

Referring now to the drawings there is illustrated the light weight gondola car of the invention, generally designated by reference numeral 2. Although the features of the invention are described with reference to a gondola car, it is within the scope of the invention to apply its teachings to other rail cars, if desired. The rail car 2 is formed with a car body 4 creating a compartment 4*a* for carrying bulk materials, such as coal, gravel, and the like. The car body 4 is supported at both ends by truck assemblies 6 and is formed by a pair of upright vertical sidewall assemblies 8 and opposed lateral end wall assemblies 10. The end wall assemblies 10 each include sloped lower floor panels 14 and upper vertical endwalls 16. The floor 18 of the car body 4 comprises a pair of concave floor panels 20 (one of which is shown in FIGS. 2 and 3) in the form of tubs or troughs positioned on each side of a longitudinally extending center sill 22. The inner longitudinal edge 24 of the concave floor panels or troughs 20 are secured to each side of the center sill 22 by riveting or welding. The outer longitudinal edge 26 of the troughs or concave floor panels 20 is affixed to respective side sills 30 to which the lower edges 32 of the side wall assemblies 8 are attached. The concave floor panels 20 extend beneath the center sill 22, and increase the volumetric capacity of compartment 4*a* of the gondola car and lower its center of gravity of car 2 for better operating characteristics. The center sill 22 extends substantially the length of the car body 4 and interconnects with draft sill 34 in a manner to be described. Each of the longitudinally extending side sills 30 includes a hollow configuration having a generally trapezoidal body 30*a* as best shown in FIG. 7. The side sill 30 (FIG. 7) is formed with a lower continuous flange 40 to which the outer longitudinal edge 26 (FIG. 3) of each concave floor panel or tube 20 is attached and an upper continuous flange 42 (FIG. 7) to which the bottom edge portion 44 of the vertical side wall assemblies 8 are attached by welding or rivets. Although side sills 30 may be comprise any beam structure, an aluminum extrusion provides a strong, lightweight structure.

Figure 1:
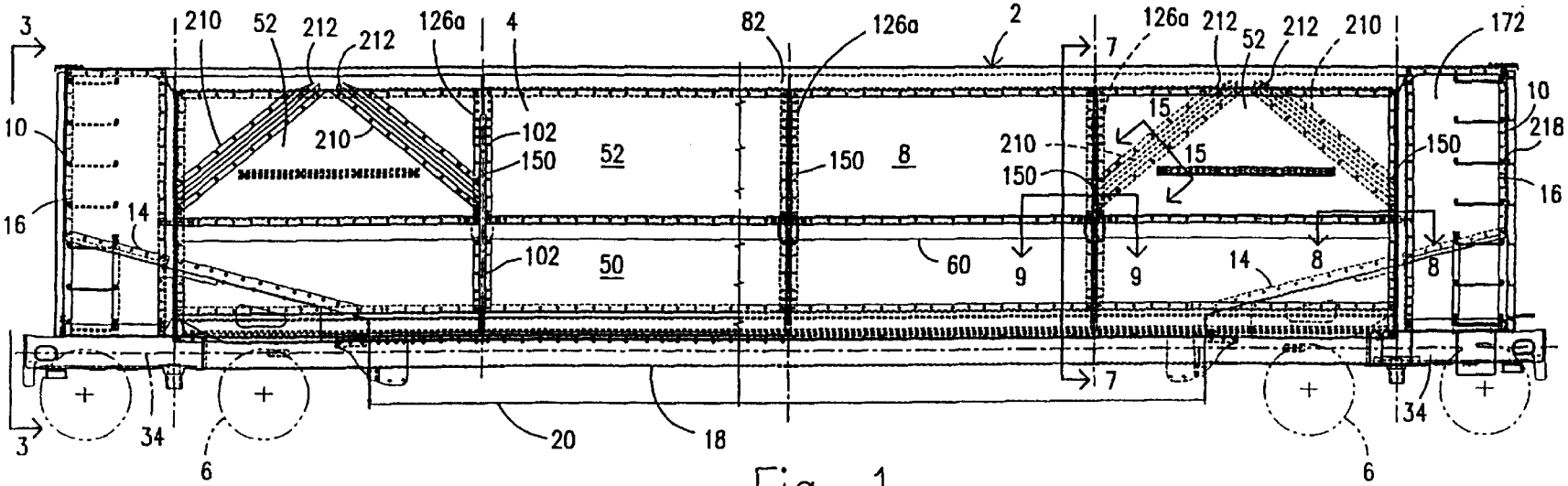
FIG. 1 is a side elevational view, with the parts removed, of the lightweight gondola car of the invention.
Figure 9:
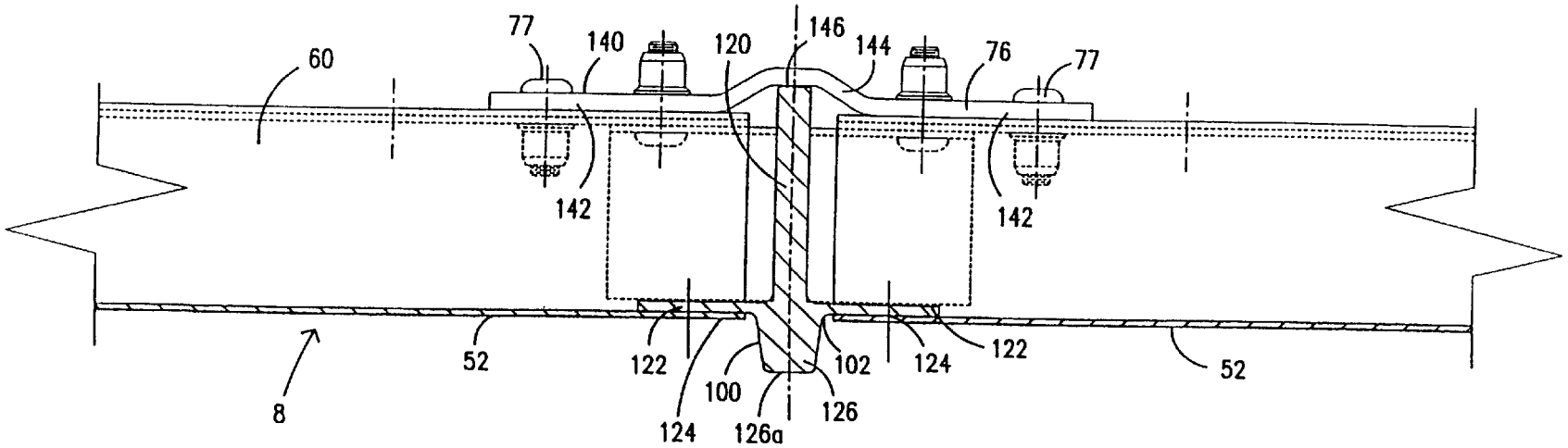
FIG. 9 is a partial top view, with parts in section, of the K-frame vertical stake taken along lines 9—9 of FIG. 1.
Figure 10:
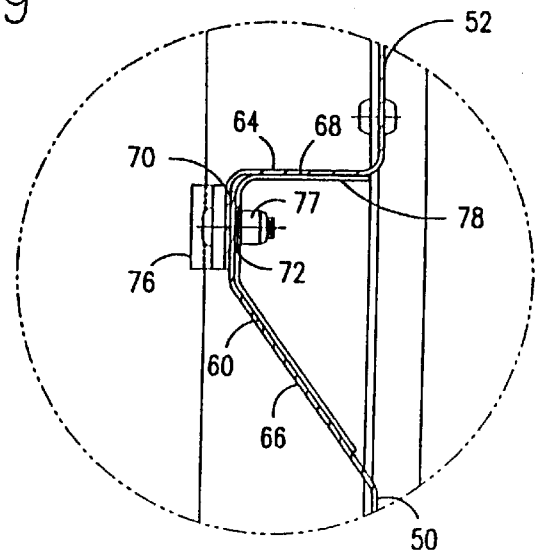
FIG. 10 is a partial enlarged end elevational view, with parts in section, of horizontal side stiffener shown in FIG. 7.

Details of the vertical side wall assemblies are best shown in FIGS. 1, 3, 7, and 9. As seen in FIGS. 1 and 7, the side wall assemblies 8 include a plurality of lower side sheets 50 which are interconnected with a plurality of upper side sheets 52 by a longitudinal extending inboard stiffener 60 (FIGS. 3, 7) extending along a horizontal seam 62. In FIG. 1, four upper and lower sheets 50, 52 are illustrated, although other numbers of side sheets can be employed dependent on various conditions and desired dimensions. The longitudinal reinforcement section 60 is created from bent portions of the bottom section 64 of the upper side sheet 52 and the upper bent-in portion 66 of the lower sheet 50 (FIGS. 7 and 10). The bottom section 64 of the top side sheet is bent horizontally inward to form the top 68 (FIG. 10) of the inboard stiffener 60 and downward to from a vertical flange 70. The upper bent-in portion 66 of bottom side sheet 50 is diagonally bent upward and includes a vertical section 72 arranged to contact the inner surface of the vertical flange of 70 of the upper side sheet 52. A plurality of horizontal side stiffener ties 76 to be described have fasteners 77 that extend through the overlapping vertical flange 70 and vertical section 72 of the upper and lower side sheets for securement as seen in FIGS. 9 and 10. In FIG. 1, three pairs of stiffener ties 76 are positioned at intermediate positions and two pairs at each end of the car are shown. The inboard stiffener 60 is formed longitudinally along the side wall assembly and resists bulging and provides enhanced strength. A side wall closure side connector plate 78 is also affixed to stiffener 60.

Figure 14:
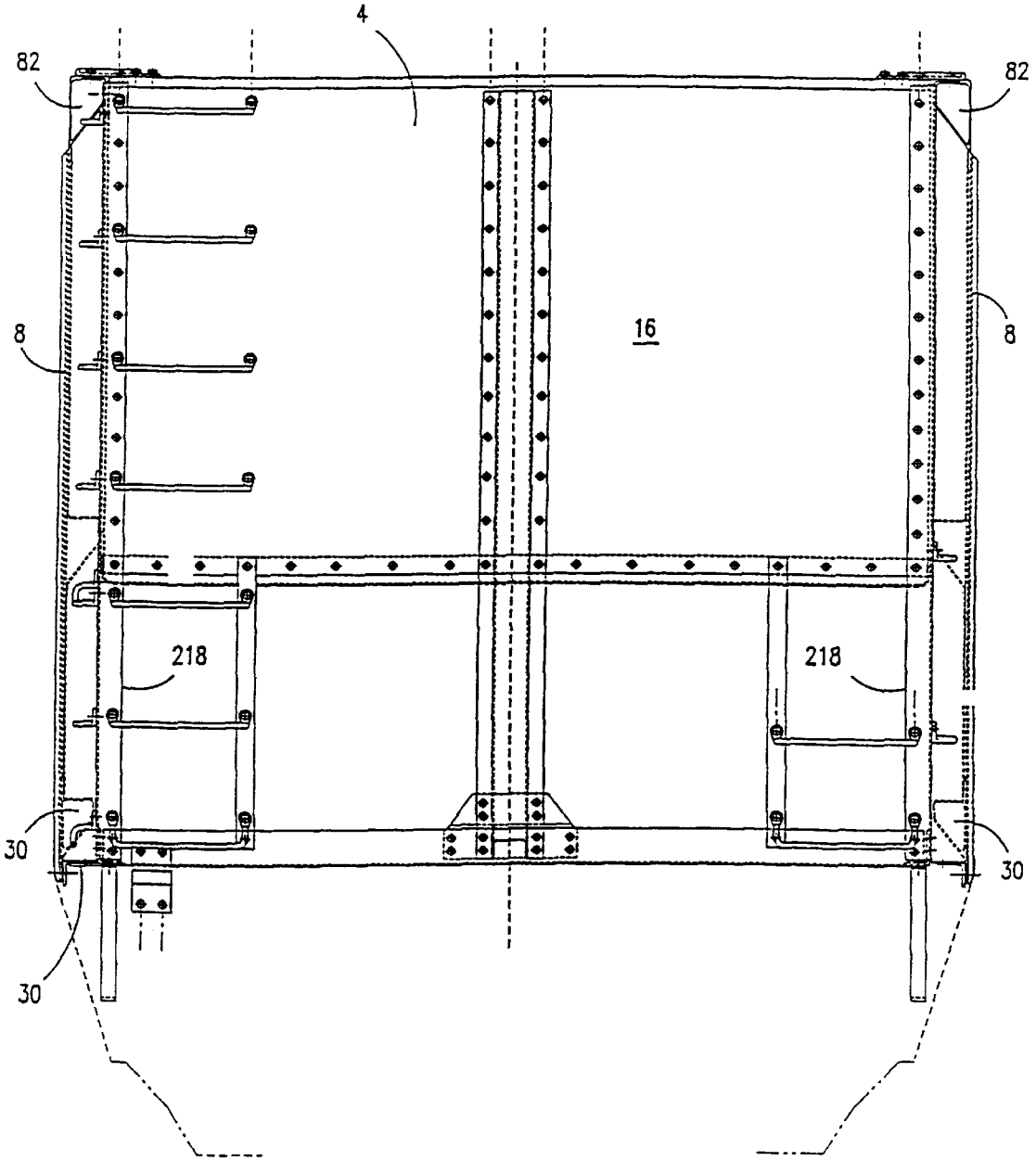
FIG. 14 is an end elevational view, with parts removed, of the gondola car of FIG. 1 showing the end construction.

The upper edge portions 80 of the upper side sheets 52 are attached by suitable welds to an elongated hollow top chord 82 having an approximate trapezoidal hollow configuration (as best seen in FIGS. 3, 7, and 14). The top chord 82 may be, for example, extruded from aluminum and the like. The upper side sheets 52 are affixed to a downward extending lip or flange 84 which is downwardly formed on the top chord 82. The shape of the top chord 82 is defined by an inner vertical wall 86, an outer vertical wall 88, a lower angled wall 90, and a horizontal top section 92 integrally connected between the two vertical walls 86, 88. The lower wall 90 of the top chord 82 interconnects with a plurality of vertical side stakes 100 on each side extending between the top chord 82 and the top of the side sill 30 inboard of the side walls.

Figure 4:
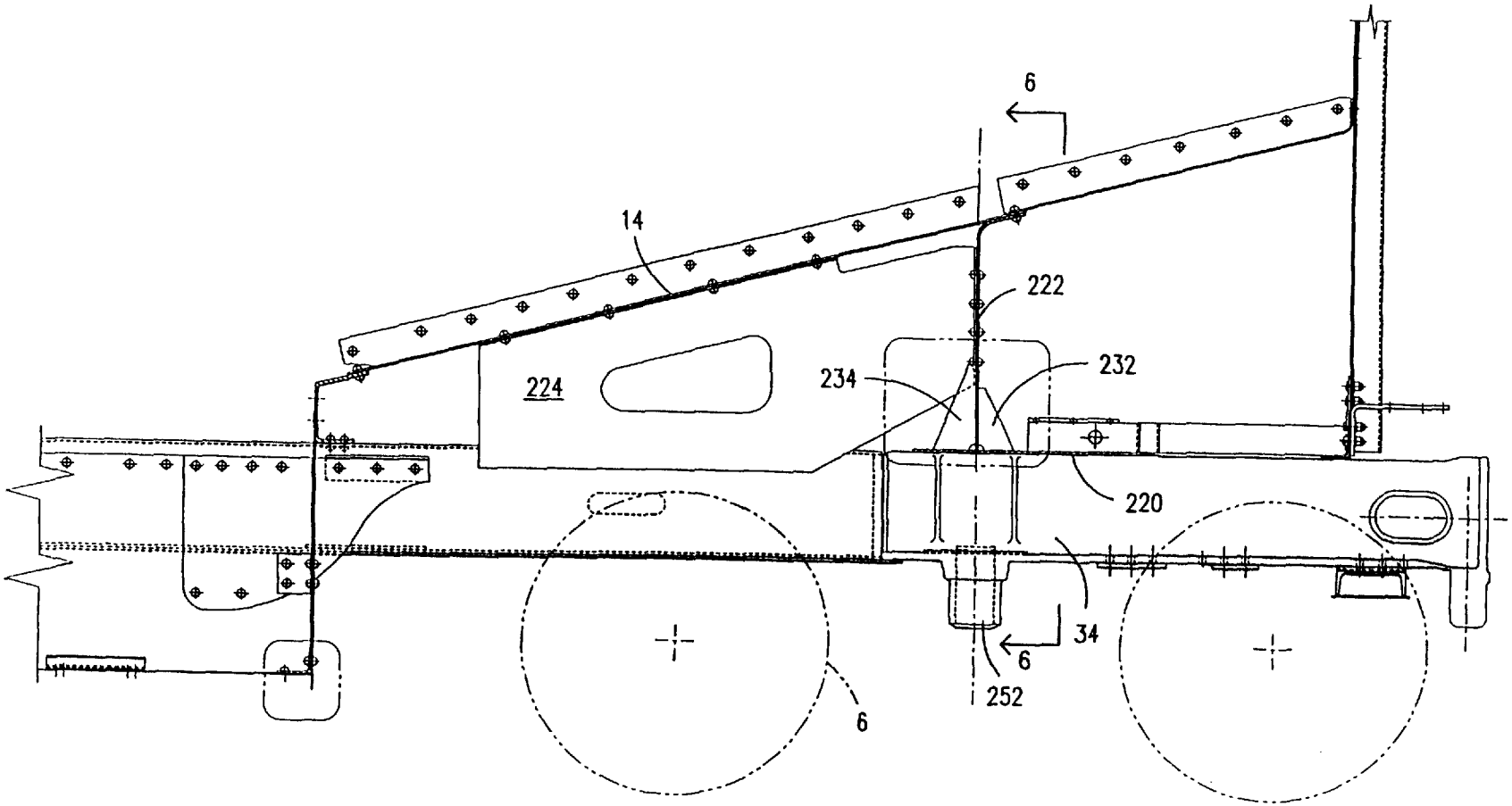
FIG. 4 is a partial side elevational view, with parts in section, of the bolster assembly of the gondola car of FIG. 1.

The construction of the side stakes 100 is best shown in FIGS. 3, 7, and 9. Each of the side stakes 100 is a solid, upright structure that serve to reinforce the vertical side wall assembly 8 at spaced locations along the length of the car body at the vertical seams 102 (FIG. 9) between adjacent upper side sheets 52 and adjacent lower side sheets 50. The seams 102 are located at the position of the internal bracing of the car in the form of a plurality of K-frames 104 (FIGS. 3 and 4). The K-frames 104 include an upper lateral member 106 extending between the opposed side stakes 100. The K-frames 104 further include a pair of downwardly extending diagonal members 108 (one of which is shown is FIG. 3) which extend from an upper connected position on side stake 100 and are attached at their lower end with center sill 22. A lower, slightly optionally sloped stiffener 110 of the K-frame 104 extends from a bottom portion of the side stake 100 on each side and is attached to center sill 22. The downwardly extending members 108 and the lower sloped stiffeners 110 are attached to the center sill 22 through a plate connector 112, that is suitably anchored within the center sill 22 by a reinforcement plate 116 (FIG. 3). The reinforcement plate 116 extends the width of the center sill and is located at all K-frame connections to center sill 22.

As seen in FIG. 9, the side stakes 100 are in a modified T-shape. The inwardly extending section 120 of the side stake 100 forms a plate which extends between the vertical seams 102 of adjacent upper and lower side sheets at the K-frame locations. A pair of opposed flanges 122 are integrally formed along the vertical height of the side stake 100 and form respective faces 124 to which the ends of the upper and lower side sheets are attached, such as by rivets and the like. An enlarged wear pad 126 having a contact surface 126*a* is integrally formed on the stem 120 in a manner to project outward from the outer plane of the side wall assemblies 8 substantially along their height to act as wear surfaces to contact the rotary dump mechanism when the gondola car is rotated to discharge a load as is well known. The wear pads 126 protect the side wall sheets 50, 52 against damage through contact with the dumping mechanism and preserve the integrity of the side wall over extended periods of time. As further shown in FIG. 9, the horizontal stiffener ties 76 are in the form of plates 140 having end portions 142 in contact with adjacent ends of the inboard stiffener 60 and a bulge area 144 in contact with a rounded end 146 of the stem 120 of the side stake 100.

Figure 5A:
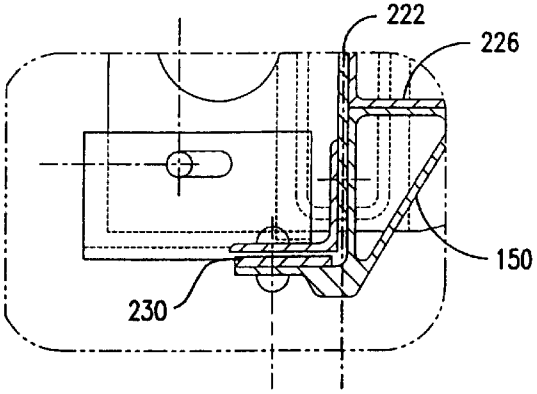
FIG. 5*a* is an enlarged top plan view of the bolster transition stake of FIG. 5.
Figure 5:
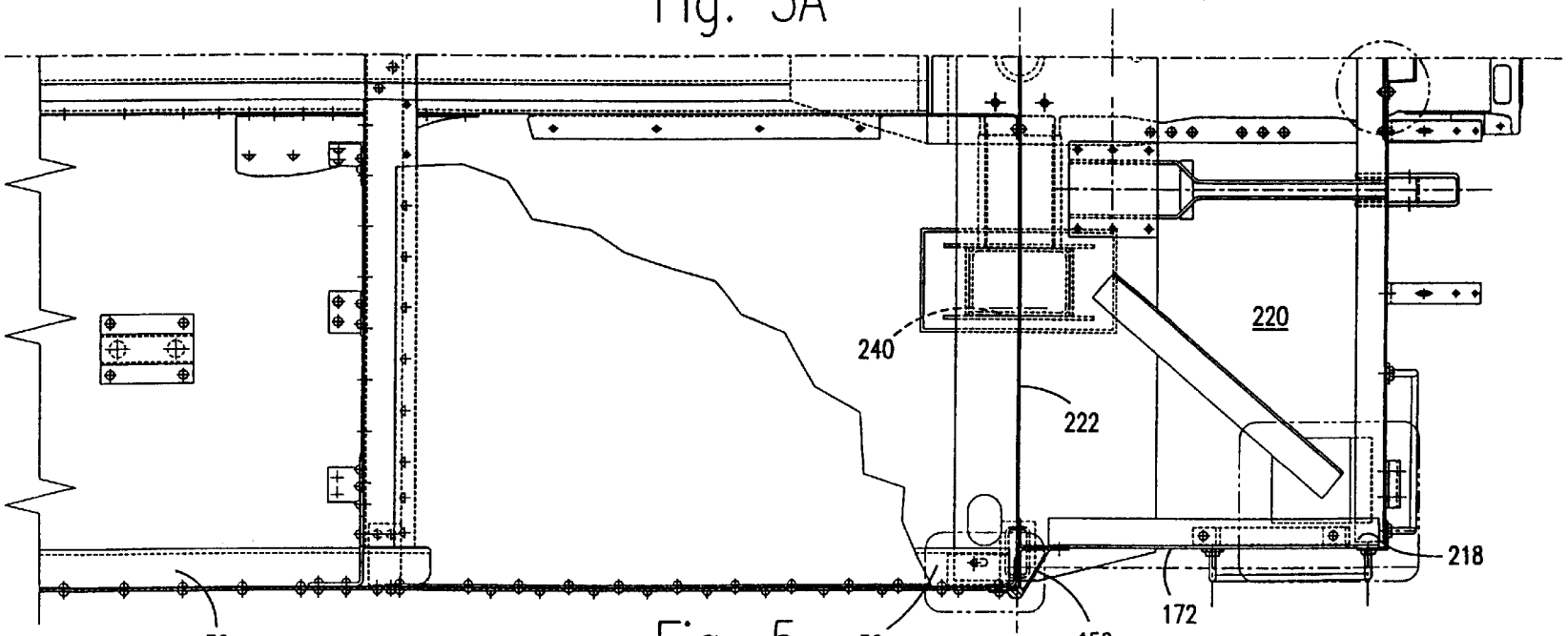
FIG. 5 is a partial top plan view, with parts in section, of the bolster assembly of FIG. 4.
Figure 8:
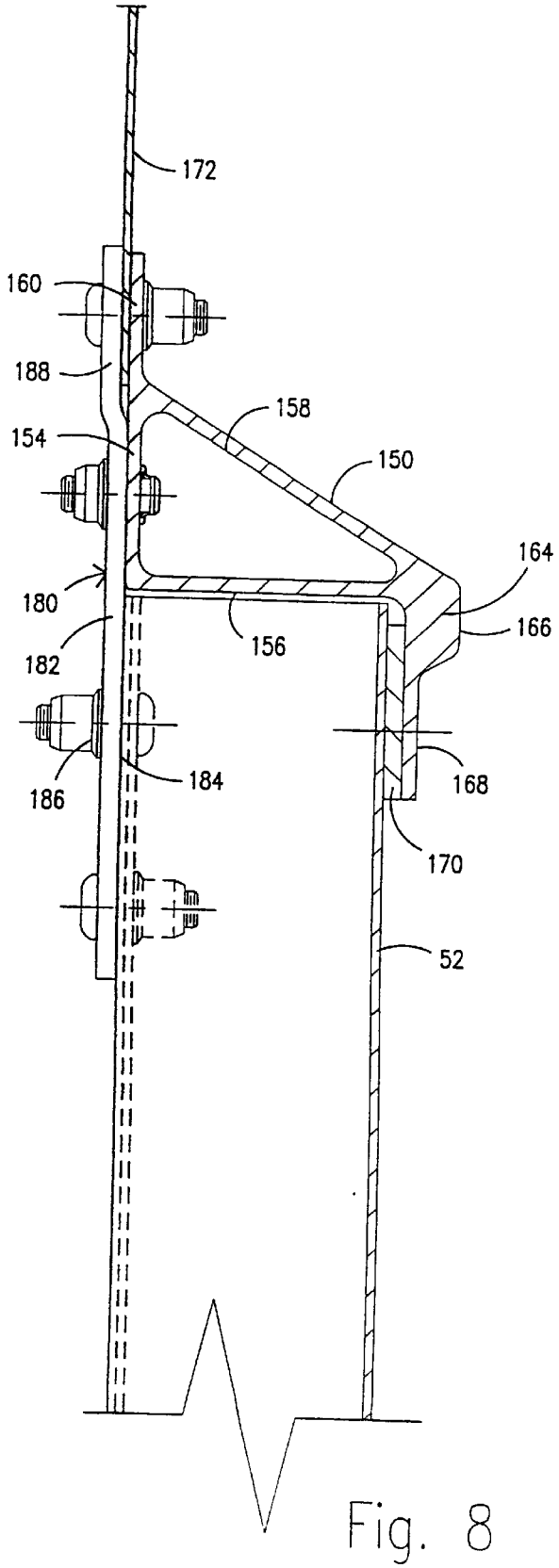
FIG. 8 is a partial top plan, with parts in section, taken along lines 8—8 of FIG. 1 showing the bolster transition stake of the invention.

As seen in FIGS. 5, 5*a*, and 8, a vertical bolster transition side stake 150 is mounted adjacent each end of the side wall assembly 8 on both sides of the car 2. The end upper and lower side sheets 50 and 52 are attached to the hollow bolster transition stakes 150 by a suitable mechanical attachment technique, such as by rivets, welds, and the like. As seen in FIG. 8, the cross-sectional configuration of the main body of the bolster stake 150 is generally triangular in shape defined by an inboard vertical wall 154 disposed along the longitudinal axis, an outwardly projecting lateral wall 156 disposed laterally of the ends of the side assemblies 8, and an integral diagonal wall 158. The inner vertical wall 154 projects outward to form a longitudinal flange 160 along its height. An enlarged portion pad 164 is formed outwardly from the lateral wall 156 and projects outward to form a wear pad 166 for the side wall in a manner similar as the T-stakes 100 provided at the K-frame connections. An outer longitudinal flange 168 extends from pad portion 164 overlapping end portions of the upper and lower side sheets 50, 52 between which a plate 170 is sandwiched (FIG. 8). The end portions of the side sheets 50, 52 and plate are attached by mechanical fasteners to the longitudinal flange 168.

As illustrated in FIGS. 1 and 8, a pair of upper vertical end side sheets 172 are mounted at the ends of the rail car 2 above the slope lower panels 14. The end side sheets 172 are inwardly disposed from the side wall assembly 58 and are riveted to the flange 160 of the side stake 150. As further seen in FIG. 8, a side stiffener tie 180 ties the ends of the horizontal stiffener 60 to the vertical bolster transition stake 150 at each end of the car 2. The tie 180 (FIG. 8) is in form of a plate 182 having a face 184 contacting the ends of the horizontal inboard stiffener 60. A plurality of threaded bolts 186 affix the bolster transition stake 150, stiffener and inboard stiffener 180 together. The plate 182 has an offset end portion 188 to receive the end of the upper end sheet 172 in attached sandwiched relationship to bolster transition stake 150. The ends of upper chord 82 are also affixed to the bolster transition stake 150 through mechanical connectors (not shown).

Figure 15:
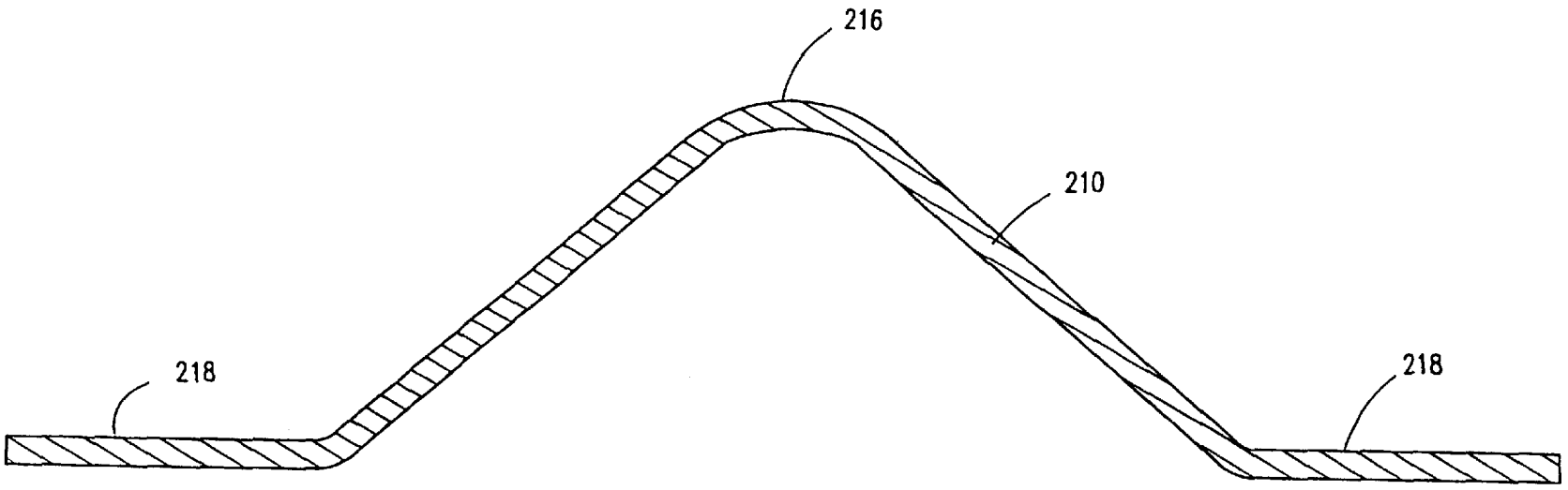
FIG. 15 is an end sectional view of a diagonal stiffener of a rail car taken along lines 15—15 of FIG. 1.

As seen in FIGS. 1, 3 and 5*b*, the end upper sheets 52 of the side wall assembly 8 are provided with diagonal side sheet stiffeners 210 (FIG. 1) having an upper end 212 affixed to the upper chord 82 by suitable mechanical fasteners. One of the diagonal stiffeners 210 diagonally extends downward for attachment to the bolster transition stake 150. The other of the diagonal side wall stiffeners 210 extends downward and is affixed by mechanical fasteners to a portion of the flange of the end vertical side stake 100 through suitable connecting plates (not shown). As seen in FIG. 15, each of the diagonal stiffeners 210 has a raised central portion 216 to increase the stiffness of the members. Flanges 218 are formed on opposite sides of the raised central portion 216 of the diagonal stiffeners 210 to provide means through which a plurality of mechanical fasteners attach the members 210 to the upper side sheets 52. The end side sheets 172 (FIG. 8) are suitable affixed to end posts 218 at each corner of the ends of the car body (see FIGS. 1, 3 and 5).

Figure 6:
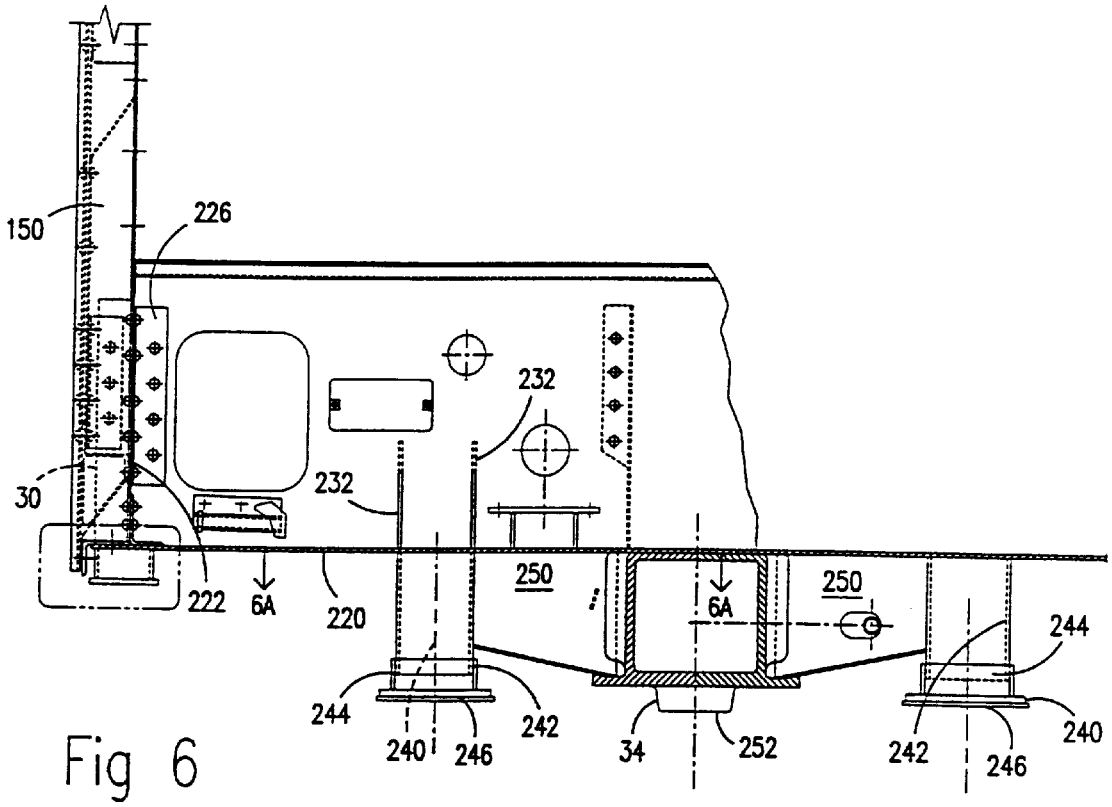
FIG. 6 is a partial end elevational view, with parts in section, of the load carriers of the gondola car taken along lines 6—6 of FIG. 4.

Referring now to FIG. 4, the lower portion of the rail car 2 above the truck assembly 6 is shown. A horizontal shear plate 220 extends the widths of the car over the draft sill 34. A bolster web 222 extends vertically in attached relationship to the top of the shear plate 220 and is affixed by a suitable technique at a bent upper edge portion to the sloped bottom panel 14. A bolster web to center sill gusset 224 is welded to the center sill 22 and is affixed to the lower wall 14 by mechanical fasteners and to the bolster web 222. The bolster web 222 is also affixed by suitable fasteners to the lateral wall 156 of the bolster transition stake 150 as best seen in FIG. 5*a*. The bolster web 222 is attached to the inner longitudinal wall 154 of the bolster transition stake 150 by means of a bolster web to stake angle 226 and mechanical fasteners as seen in FIGS. 5*a* and 6. The bolster transition stake 150 is attached to the side sheet end panels 50, 52 and to the side sill 30 by mechanical fasteners to create a load transmitting connection between the bolster web 222, the side sill 30, the side sheets 50, 52, sloped panel 14, and the top chord 82. The sloped end sheet 14 is attached to the bolster transition stake 150 by means of shim 230 (FIG. 5*a*).

Figure 6A:
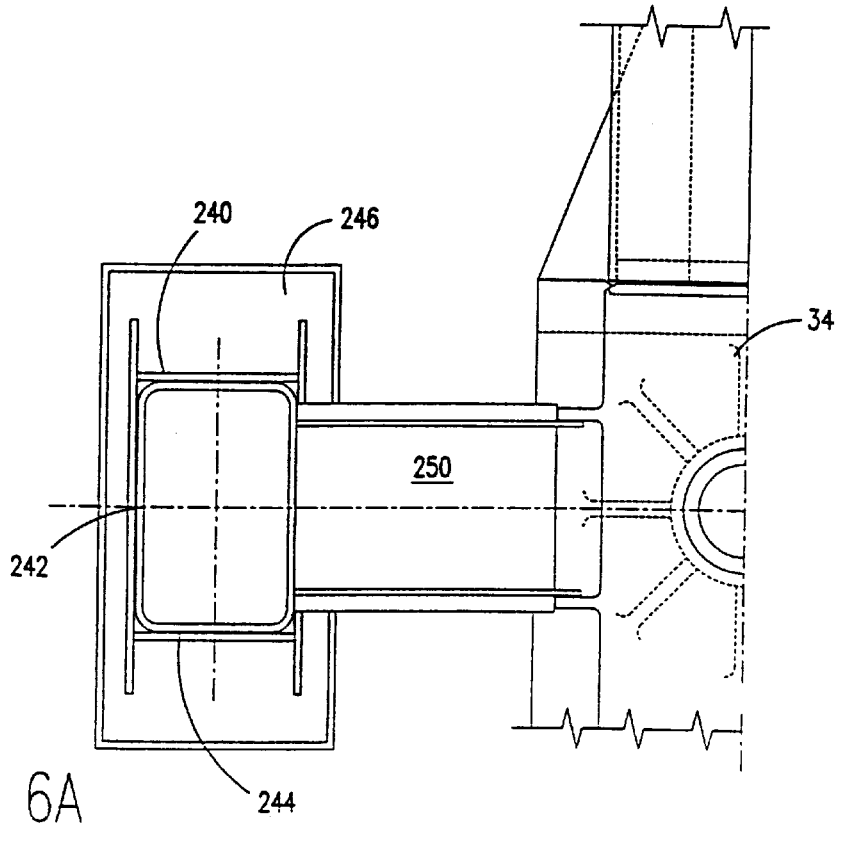
FIG. 6*a* is a top partial plan view of the load carrier of FIG. 6 taken along lines 6*a*—6*a;*

On both sides of the bolster web 222, two pairs of gussets 232, 234 support the bolster web on the shear plate 220 as seen in FIGS. 4 and 6 (one pair being shown in FIG. 6). It should be understood that two other pairs of gussets 232, 234 are positioned on the other side of the draft sill 34, but not shown. A pair of tube load carriers 240 are mounted below the shear plate 220 beneath the position of the gussets 232, 234 and project down into operative contact with the truck assembly (not shown). As seen in FIGS. 4, 5, and 6, the tube load carriers 242 are arranged to carry the entire load of the car, such that the shear plate 222 transmits the load to the transition stake 150 and upward into the car body 4. The load carrier 240 comprises an upper hollow rectangular tube 242 affixed to the shear plate 220 by welding and the like. A truck cap 244 having a rectangular box-like configuration is telescopically retained on the bottom end of the load carrier tube 242. The outer truck cap 244 is telescopically mounted so that it can be adjusted relative to the upper tube 242 to compensate for height variations during assembly of the car. Welds are inserted between the cap 244 and the tube 242 for retention at the selected position. The cap 244 is affixed by welds to a horizontal plate 246, preferably of a heavy duty material, such as stainless steel, and rests on the truck assembly (not shown). As best seen in FIGS. 6 and 6*a*, a pair of side bearing webs 250 are disposed between the draft sill and attachment thereto and the upper tube of the load carrier on both sides of the car. A pin 252 extends downward from the draft sill 34 in connection to the truck assemblies (not shown).

Figure 11:
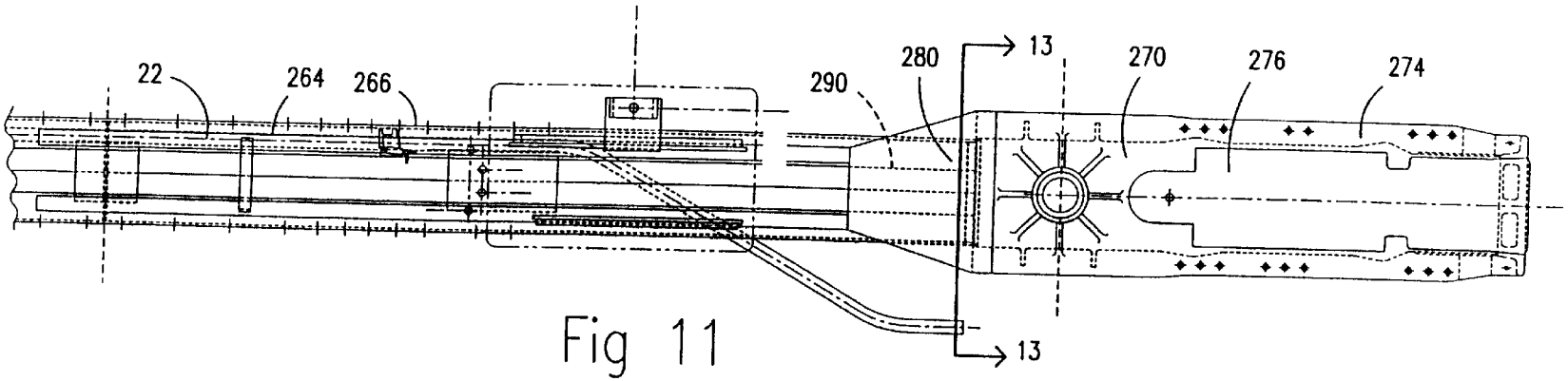
FIG. 11 is a bottom plan view, with parts removed, of the transition tie between the center sill and draft sill of the gondola car of FIG. 1.
Figure 12:
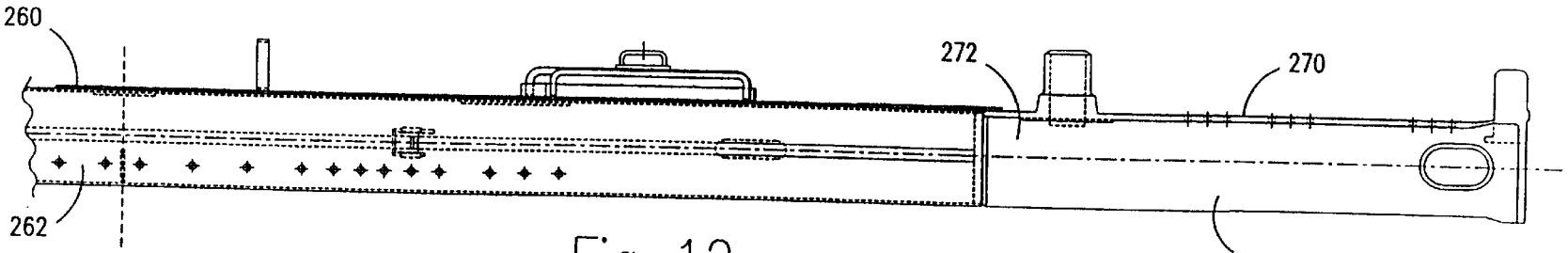
FIG. 12 is a side elevational view, with parts removed, of the transition tie of FIG. 11.
Figure 13:
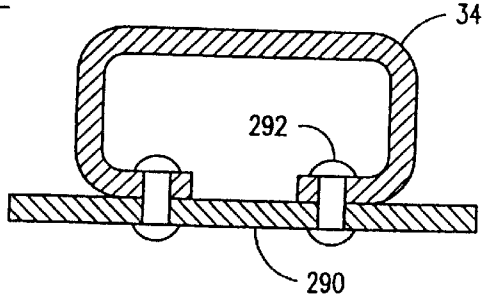
FIG. 13 is a partial enlarged elevational view, with parts in section, taken along lines 13—13 of FIG. 11.

Referring now to FIGS. 11, 12, and 13, there is illustrated the transition between the center sill 22 and the draft sill 34 at each end of the car. The center sill 22 is formed as a hollow rectangular member having upper wall 260, side walls 262, and a pair of bottom flanges 264 forming elongated longitudinal opening 266. Similarly the draft sill 34 includes a hollow, generally rectangular configuration formed by an upper surface 270, a pair of side surfaces 272, and a pair of lower opposed flanges 274 forming an elongated opening 276. Accordingly, the inboard end 280 of draft sill 34 tapers inward to correspond to width of the center sill 22. Because of curved surfaces, it was difficult in the past to obtain a desirable weld between the center sill and the draft sill. The ends of the center sill 22 and draft sill 34 are affixed to each other in the invention herein by means of a draft sill to center sill tie plate 290. The tie plate 290 is affixed to the flanges 274 of the draft sill 34 by a plurality of bolts 292 as seen in FIG. 13 or similar attachment techniques through both flanges. The draft sill to center sill tie plate 290 is also affixed to the lower flanges of the center sill by a plurality of rivets and the like (not shown). As seen in FIG. 13, the draft sill to center sill tie plate 290 is a flat plate member having a generally rectangular configuration suitable to be retained by both the draft sill 34 and the center sill 22.

What is claimed is:

1. A rail car comprising:

a body having a longitudinal extending center sill and being carried at each end by opposed truck assemblies, wherein said body forms a cargo compartment, and said body having a pair of vertical sidewall assemblies to define the sides of said compartment, said side wall assemblies having a plurality of side wall sheets arranged side by side between said truck assemblies to form a plurality of vertical seams, and a plurality of vertical side stakes being disposed between the ends of adjacent ones of said side wall sheets, said vertical side stakes being disposed inward of said vertical side sheets and having a portion disposed in said vertical seams between adjacent ones of said side wall sheets, and said body having a plurality of load carriers at each end being supported on said opposed truck assemblies, said load carriers transmitting the entire loading to said truck assemblies.

2. The rail car of claim 1 wherein each said vertical side stake includes an outer portion projecting outward from said plurality of side wall sheets.

3. The rail car of claim 2 wherein said outer portion forms an external wear pad for protecting said plurality of side wall sheets.

4. The rail car of claim 3 wherein said pad has a generally bulb-shaped configuration.

5. The rail car of claim 2 wherein said plurality of vertical side stakes have a generally T-shaped configuration.

6. The rail car of claim 2 wherein said plurality of vertical side stakes include an inwardly extending flat portion and an integral flat member affixed to said flat portion.

7. A rail car comprising:

body having a longitudinal extending center sill and being carried at each end by opposed truck assemblies, and said body having a plurality of load carriers at each end being supported on said opposed truck assemblies, said load carriers transmitting the entire loading to said truck assemblies, said body having opposed side walls, said opposed side walls each including a plurality of generally vertical sheets each having a top edge and a bottom edge, and said plurality of sheets of said opposed side walls having inwardly projecting portions forming longitudinal stiffeners extending substantially along the length of said opposed side walls between said top edge and said bottom edge of said plurality of sheets, wherein said plurality of sheets of said opposed walls include a plurality of upper sheets and a plurality of lower sheets respectively having lower edge portions of said upper sheets and upper edge portions of said lower sheets lying in adjoining relationship along a longitudinal line, wherein said lower edge portions and said upper edge portions form said inwardly projecting portions, wherein said lower edge portions and said upper edge portions overlap each other in contact along said longitudinal axis, and wherein said lower edge portions of said upper sheets are bent inwardly and downwardly relative to said side walls, said upper edge portions of said lower sheets being bent inwardly and upwardly into contact with said lower end portions.

8. A rail car comprising:

body having a longitudinal extending center sill and being carried at each end by opposed truck assemblies, and said body having a plurality of load carriers at each end being supported on said opposed truck assemblies, said load carriers transmitting the entire loading to said truck assemblies, said body having opposed side walls, said opposed side walls each including a plurality of generally vertical sheets each having a top edge, and a bottom edge, and said plurality of sheets of said opposed side walls having inwardly projecting portions forming longitudinal stiffeners extending substantially along the length of said opposed side walls between said top edge and said bottom edge of said plurality of sheets, wherein said plurality of sheets of said opposed walls include a plurality of upper sheets and a plurality of lower sheets respectively having lower edge portions of said upper sheets and upper edge portions of said lower sheets lying in adjoining relationship along a longitudinal line, wherein said lower edge portions and said upper edge portions form said inwardly projecting portions, wherein said lower edge portions and said upper edge portions overlap each other in contact along said longitudinal axis, and further including securement means securing said lower edge portions and said upper edge portions together to form unitary longitudinal stiffeners.

9. A rail car comprising:

body having a longitudinal extending center sill and being carried at each end by opposed truck assemblies, and said body having a plurality of load carriers at each end being supported on said opposed truck assemblies, said load carriers transmitting the entire loading to said truck assemblies, said body having opposed side walls, said opposed side walls each including a plurality of generally vertical sheets each having a top edge and a bottom edge, and said plurality of sheets of said opposed side walls having inwardly projecting portions forming longitudinal stiffeners extending substantially along the length of said opposed side walls between said top edge and said bottom edge of said plurality of sheets, and wherein said plurality of side sheets of each side wall includes a plurality of side sheets disposed side by side and forming a vertical seam, vertical side stakes being disposed interiorly of said opposed side walls and having a projecting portion extending through said vertical seam.

10. The rail car according to claim 9 wherein said projecting portion forms a vertical wear pad projecting beyond said side wall.

11. A rail car comprising:

body having a longitudinal extending center sill and being carried at each end by opposed truck assemblies, and said body having a plurality of load carriers at each end being supported on said opposed truck assemblies, said load carriers transmitting the entire loading to said truck assemblies, wherein said body has a pair of side sills being disposed on each side of said center sill, a pair of side walls being carried by said side sills, a longitudinal upper chord being attached to the top portion of each of said side walls, a plurality of bolster webs being carried by each of said truck assemblies, and a plurality of vertical bolster transition stakes being connected to the ends of said pair of side walls each of said plurality of vertical bolster transition stakes being connected to one of said plurality of bolster webs, to one of said upper chords and to an end of one of said pair of side sills, and wherein each of said vertical bolster transition stakes include a longitudinal wall, a lateral wall integral with said longitudinal wall and extending laterally relative to said center sill, and a diagonal wall connecting said longitudinal wall and said lateral wall.

12. The rail car according to claim 11 wherein each said bolster transition stake further includes a longitudinal extending flange integrally connected to said lateral wall and said diagonal wall, the ends of said pair of side walls being integrally attached to said longitudinal flange.

13. The rail car according to claim 11 further including a projecting portion integrally connected to said lateral and diagonal wall of each of said bolster transition stakes, said projecting portion forming a protective surface projecting outward from said pair of side walls.

14. The rail car according to claim 11 wherein ends of said pair of side sills are affixed to said longitudinal wall of said vertical bolster transition stake.

15. The rail car according to claim 1 wherein said plurality of bolster webs are each connected to said longitudinal wall of said bolster transition stake.

16. A rail car comprising:

body having a longitudinal extending center sill and being carried at each end by opposed truck assemblies, and said body having a plurality of load carriers at each end being supported on said opposed truck assemblies, said load carriers transmitting the entire loading to said truck assemblies, wherein said plurality of load carriers each includes a vertical member, further including a lower member being affixed on said vertical member and being in contact with one of said truck assemblies, wherein said lower member includes a flat plate in contact with the truck assemblies.

17. The rail car of claim 16, wherein said body having opposed side walls, said opposed side walls each including a plurality of generally vertical sheets each having a top edge and a bottom edge, and said plurality of sheets of said opposed side walls having inwardly projecting portions forming longitudinal stiffiners extending substantially along the length of said opposed side walls between said top edge and said bottom edge of said plurality of sheets.

18. The rail car according to claim 17 wherein said plurality of sheets of said opposed walls include a plurality of upper sheets and a plurality of lower sheets respectively having lower edge portions of said upper sheets and upper edge portions of said lower sheets lying in adjoining relationship along the longitudinal line.

19. The rail car according to claim 18 wherein said lower edge portions and said upper edge portions form said inwardly projecting portions.

20. The rail car according to claim 19 wherein said lower edge portions and said upper edge portions overlap each other in contact along said longitudinal axis.

21. The rail car according to claim 17 wherein said longitudinal stiffeners are continuous along each side wall.

22. The rail car according to claim 17 further including a longitudinal side sill extending below each of said side walls, each said side wall having a continuous upper flange, said plurality of upper sheet being attached to said continuous upper flange.

23. The rail car according to claim 17 further including floor sheets forming at least a portion of a floor disposed between said side walls, each of said side walls having a lower continuous flange, said floor sheets having outer edge portions affixed to said lower flanges.

24. The rail car according to claim 17 wherein said longitudinal stiffeners are continuous along their length.

25. The rail car of claim 16, wherein said body has a pair of side sills being disposed on each side of said center sill, a pair of side walls being carried by said side sills, a longitudinal upper chord being attached to the top portion of each of said side walls, a plurality of bolster webs being carried by each of said truck assemblies, and a plurality of vertical bolster transition stakes being connected to the ends of said pair of side walls, each of said plurality of vertical bolster transition stakes being connected to one of said plurality of bolster webs, to one of said upper chords and to an end of one of said pair of side sills.

26. The rail car according to claim 25 wherein each of said bolster transition stakes includes a hollow configuration.

27. The rail car according to claim 16 wherein said body includes a horizontal shear plate at each end, said plurality of load carriers being attached to the bottom of said shear plates.

28. The rail car according to claim 27 wherein said body further includes a pair of bolster webs affixed to said shear plate.

29. The rail car according to claim 28 wherein said body includes a pair of bolster transition stakes at each end, said pair of bolster webs each being connected to said bolster transition stake.

30. The rail car according to claim 16 wherein each said vertical member is hollow.

31. The rail car according to claim 16 wherein said lower member is adjustable relative to said vertical member, said lower member being affixed at a selected position on said vertical member.

32. The rail car according to claim 16 wherein said lower member includes a hollow box-shaped member.

33. The rail car of claim 16, further including a pair of draft sills, connecting means for connecting said pair of draft sills to said center sill at each end of said center sill, and said connecting means including a plate affixed to said center sill and each of said pair of draft sills.

34. The rail car according to claim 33 wherein said plate is affixed to a bottom portion of said center sill and each of said pair of draft sills.

35. The rail car of claim 16, wherein said body has a pair of opposed side walls forming a cargo compartment, said opposed side walls having a plurality of side panels lying side by side along the length of said pair of side walls, and a plurality of diagonal truss members being affixed to the interior of said side walls.

36. A rail car comprising:

a body having a longitudinal extending center sill and being carried at each end by opposed truck assemblies, and said body having a plurality of load carriers at each end being supported on said opposed truck assemblies, said load carriers transmitting the entire loading to said truck assemblies, wherein said Plurality of load carriers including a vertical member and further including a lower member being affixed on said vertical member and being in contact with one of said truck assemblies, wherein said lower member is adjustable relative to said vertical member, said lower member being affixed at a selected position on said vertical member, and wherein said lower member is telescopically retained on said vertical member.

37. A rail car comprising:

a body having a longitudinal extending center sill and being carried at each end by opposed truck assemblies, and said body having a plurality of load carriers at each end being supported on said opposed truck assemblies, said load carriers transmitting the entire loading to said truck assemblies wherein said body has a pair of opposed side walls forming a cargo compartment, said opposed side walls having a plurality of side panels lying side by side along the length of said pair of side walls, and a plurality of diagonal truss members being affixed to the interior of said side walls, and wherein said body includes a plurality of vertical stakes connected to said side panels, said body further includes a longitudinal chord disposed above said side panels, each of said plurality of diagonal truss members extending between said top chord and one of said vertical stakes.

38. The rail car according to claim 37 wherein said diagonal truss members are affixed to the inner surface of said side panels.

39. The rail car according to claim 38 wherein each of said diagonal truss members includes a bulging central portion.

40. A rail car comprising:

a body having a longitudinal extending center sill and being carried at each end by opposed truck assemblies, and said body having a plurality of load carriers at each end being supported on said opposed truck assemblies, said load carriers transmitting the entire loading to said truck assemblies, wherein said longitudinal extending center sill has an internal space, and said body further including opposed side wall means disposed on opposite sides of said center sill, said body further including a support beam extending between each of said side wall means and said center sill, attachment means for connecting said center sill to said side wall means, and said attachment means having anchor means extending into said internal space of said center sill in attached relationship to said center sill.

41. The rail car according to claim 40 wherein said anchor means includes a plate disposed at least partially within said intend space.

* * * * *

UNITED STATES PATENT AND TRADEMARK OFFICE

CERTIFICATE OF CORRECTION

PATENT NO. : 6,148,735
DATED : November 21, 2000
INVENTOR(S) : Kerry L. Sauter et al.

It is certified that error appears in the above-identified patent and that said Letters Patent is hereby corrected as shown below:

Column 8, claim 15,
Line 62, "according to claim 1" should read -- according to claim 11 --.

Column 12, claim 41,-- intend space"
Line 11, "intend space" should read -- internal space --.

Signed and Sealed this

Sixth Day of November, 2001

*Attest:*

Nicholas P. Godici

NICHOLAS P. GODICI
*Acting Director of the United States Patent and Trademark Office*

*Attesting Officer*